US008505551B2

(12) United States Patent
Moretti

(10) Patent No.: US 8,505,551 B2
(45) Date of Patent: Aug. 13, 2013

(54) EXFOLIATING SHOWER MAT

(76) Inventor: Josephine Moretti, Staten Island, NY (US)

( * ) Notice: Subject to any disclaimer, the term of this patent is extended or adjusted under 35 U.S.C. 154(b) by 94 days.

(21) Appl. No.: 12/381,897

(22) Filed: Mar. 16, 2009

(65) Prior Publication Data

US 2009/0241978 A1 Oct. 1, 2009

Related U.S. Application Data

(60) Provisional application No. 61/069,832, filed on Mar. 17, 2008.

(51) Int. Cl.

| | |
|---|---|
| ***A45D 24/00*** | (2006.01) |
| ***A45D 29/18*** | (2006.01) |
| ***A47K 7/02*** | (2006.01) |
| ***A47L 1/06*** | (2006.01) |
| ***A47L 13/10*** | (2006.01) |
| ***A47L 23/04*** | (2006.01) |
| ***A47L 25/00*** | (2006.01) |
| ***A47L 17/08*** | (2006.01) |
| ***B43L 21/00*** | (2006.01) |
| ***A46B 9/02*** | (2006.01) |
| ***A61H 7/00*** | (2006.01) |
| ***A61H 19/00*** | (2006.01) |

(52) U.S. Cl.

USPC ..... 132/200; 132/76.4; 4/606; 15/215; 15/160; 601/136

(58) Field of Classification Search

USPC ..... 132/200, 207, 333, 76.4, 75.6, 73, 132/73.5, 76.5; 4/606, 622, 574.1, 581, 582, 4/583, 585, 580; 15/104.16, 215–217, 227, 15/104.92, 104.93, 229.11, 110, 210.1, 160, 15/161; 601/136, 154; 451/538, 539

See application file for complete search history.

(56) References Cited

U.S. PATENT DOCUMENTS

| | | | | |
|---|---|---|---|---|
| 4,512,044 | A * | 4/1985 | Clark | 4/581 |
| 4,712,552 | A * | 12/1987 | Pangburn | 606/131 |
| 5,118,201 | A * | 6/1992 | Cook | 383/12 |
| 5,293,660 | A * | 3/1994 | Park | 15/160 |
| 5,575,034 | A * | 11/1996 | Biernacinski et al. | 15/217 |
| 5,849,051 | A * | 12/1998 | Beardsley et al. | 51/295 |
| 6,142,156 | A * | 11/2000 | Brunderman | 132/76.4 |
| 6,150,004 | A * | 11/2000 | Oikawa et al. | 428/141 |
| 6,210,350 | B1 * | 4/2001 | Finch | 601/136 |
| 6,226,811 | B1 * | 5/2001 | Fagan | 4/606 |
| 6,253,407 | B1 * | 7/2001 | Bjelkevig | 15/160 |
| 6,405,400 | B1 * | 6/2002 | McClain | 15/160 |
| 6,530,096 | B1 * | 3/2003 | Mayhew et al. | 4/583 |
| 6,554,782 | B2 * | 4/2003 | Robbins et al. | 601/28 |
| 6,662,398 | B1 * | 12/2003 | Thomson | 15/104.92 |
| 6,708,351 | B2 * | 3/2004 | Sullinger | 4/559 |
| 6,920,655 | B2 * | 7/2005 | Mitchell | 5/417 |
| 7,578,021 | B1 * | 8/2009 | Figueroa | 15/104.92 |
| 7,712,474 | B2 * | 5/2010 | Dixon | 132/76.4 |
| 2003/0204927 | A1 * | 11/2003 | Kelly | 15/160 |
| 2004/0261208 | A1 * | 12/2004 | McKay | 15/215 |

(Continued)

*Primary Examiner* — Vanitha Elgart

(74) *Attorney, Agent, or Firm* — Philip M. Weiss; Weiss & Weiss

(57) ABSTRACT

A device and method for removing dead skin from a person's foot by using a mat made of a foamy, cushioned, and light weight material. The mat has an upper surface and bottom surface. The upper surface has a rough or sandy like surface. The mat is further has a device for holding the bottom surface against a floor.

15 Claims, 2 Drawing Sheets

(56) References Cited

U.S. PATENT DOCUMENTS

| | | | | |
|---|---|---|---|---|
| 2004/0261209 | A1* | 12/2004 | McKay | 15/215 |
| 2007/0022527 | A1* | 2/2007 | Russo et al. | 4/606 |
| 2007/0044261 | A1* | 3/2007 | Bolton | 15/210.1 |
| 2007/0089758 | A1* | 4/2007 | Koutscumbos | 132/76.4 |
| 2008/0216855 | A1* | 9/2008 | Nasca | 132/76.5 |
| 2008/0235892 | A1* | 10/2008 | Williams | 15/210.1 |
| 2009/0159092 | A1* | 6/2009 | Munoz et al. | 132/76.4 |
| 2010/0139678 | A1* | 6/2010 | Guzzo | 132/76.4 |

* cited by examiner

EXFOLIATING SHOWER MAT

RELATED APPLICATIONS

This application is based on provisional application Ser. No. 61/069,832 filed Mar. 17, 2008.

FIELD OF THE INVENTION

The present invention relates to a foot exfoliating shower mat.

BACKGROUND OF THE INVENTION

U.S. Pat. No. 6,662,398 relates to a hands free foot scrubber. The bath mat includes a raised foot pad area having bristles on an upper surface and an enclosed refillable bladder containing liquid soap fitting within the under surface below the foot pad. Foot pressure causes soap to be released through tubular passages in the bladder engaging corresponding passages in the foot pad. Feet may be cleaned by scrubbing on the bristles without having to bend over or use the hands. The mat includes water drain holes and suction cups on the bottom of the mat and bladder which hold the components in place.

U.S. Pat. No. 5,575,034 relates to a foot cleaning and massaging mat system, comprising a mat in a generally rectangular configuration. The mat system is comprised of an upper planar surface and a lower planar surface which are coupled around their periphery with an outwardly directed projection. An aperture is formed in the center of the mat and extends completely therethrough. An upwardly extending recess is formed from the lower surface of the mat peripherally around the aperture. An insert is positioned within the recess and has a plurality of apertures in a symmetric configuration. A plurality of upstanding bristle-like members extend upwardly from the upper surface of the mat between the aperture and the periphery.

U.S. Pat. No. 6,253,407 relates to a foot scrubber designed to be placed on a shower floor. The foot scrubber consists of a base having an upper surface, a lower surface and side edges. From the upper surface extends upward a multiplicity of bristles. To use the scrubber, a person applies soap to the bristles and then rubs their foot on the bristles.

U.S. Pat. No. 6,530,096 relates to a foot rejuvenation shower apparatus. The device is constructed of a lower surface that is releasably engaged with a floor and an upper portion with a selectively applicable upper surface for removing dead skin of a foot of a user.

US patent publication no. 2006/0185071 relates to a therapeutic floor mat system and method. The system includes a mat having an aromatherapy cavity. The cavity may be formed to at least partially hold an aromatic substance. The mat may work as a shower mat.

Pedi-Quick Step-N-Smooth shower foot file relates to a device which allows a user to file their feet while standing in the shower. The device quickly reduces corns, calluses and rough, dry skin from bottoms of feet. The device has a non-skid backing. The device is placed on the shower floor. The water is turned on to wet the file. A user steps on the device with two feet. Using one foot at a time, a user moves one foot toward themselves to file skin, making sure the repeated strokes are in the same direction. Change feet and repeat the process. The product is rinsed after use, and the mat is stood upright against a shower wall to allow it to air dry.

SUMMARY OF THE INVENTION

The present invention relates to a bath mat that is used in the shower to remove dead skin from a person's foot. The mat is made of a foamy, cushioned, light weight material with a rough sandy like surface. The mat further comprises a bullnose edging. The dead skin is removed while a user is showering, they rub their feet on the sandy surface without bending or use of the hands.

It is an object of the present invention for the mat to comprise, PVC, plastic, rubber, composite, soft-foam, silicone, or vinyl. It is an object of the present invention for the abrasive material to be made of a synthetic material. It is an object of the present invention for the abrasive material to be made of a natural material. It is an object of the present invention for the abrasive material to comprise sand, rock, etc.

It is an object of the present invention for the mat to be injected with air.

It is an object of the present invention for the mat to include suction cups or a suction channel on the bottom of the mat which holds the mat in place. It is an object of the present invention for the mat to have antibacterial and mildew resistant properties.

It is an object of the present invention for the mat to be rolled up when not in use. It is an object of the present invention for the mat to be hang dried. It is an object of the present invention for the mat to be big enough so that a person can stand on the mat with both feet.

It is an object of the present invention for the mat to have a piece cut out to fit over a drain, or for the mat to have perforations so as to allow water or hair and dead skin to exit the mat and filter through the drain.

It is an object of the present invention for the mat to have a material sprayed onto it which allows the mat to become sandy and abrasive to allow a user to scrape dead skin off of their feet.

It is an object of the present invention for the mat to be made of two pieces. One bottom part of the mat to be made of a light weight foam material with an adhesive device so that it stays in the bath or shower. A top layer is added to the bottom layer. The top layer consists of a sandy or abrasive material. An adhesive material is placed between the two layers so that they stay together. In this manner when the abrasive layer is no longer abrasive, it can be replaced with a new layer.

It is an object of the present invention for the mat to have a beveled edge.

It is an object of the present invention for the mat to have a back portion with a ridge. It is an object of the present invention for the ridge to provide an area for a user to massage their feet by moving their feet in a back and forth manner over the ridge. It is an object of the present invention for the back portion of the mat to be made of a rougher grade than the forward portion as to provide a surface for massaging the feet. It is an object of the present invention for the front portion to have no ridges and be made of a smooth material, having a non-abrasive surface.

It is an object of the present invention for the system to include a mesh bag. It is an object of the present invention for the bag to be made of nylon. It is an object of the present invention for the bag to have antibacterial and mildew resistant properties. It is an object of the present invention for the mat to be able to be rolled up and placed in the bag and drip dried after use.

It is an object of the present invention for the mat to be in the shape of an oval. It is an object of the present invention for the mat to be approximately 12" to 16" in size.

It is an object of the present invention for the mat to have a non-slip surface.

It is an object of the present invention for the mat to have smooth surfaces on the edges and the abrasive material in the center of the mat.

It is an object of the present invention for the mat to be made of a non-latex material.

DETAILED DESCRIPTION OF THE INVENTION

The present invention relates to a bath mat in the shower or bath tub to remove dead skin from a person's foot. The mat is made of a foamy, cushioned, light weight material with a rough sandy like surface. In a preferred embodiment the mat further comprises a bullnose edging. Dead skin is removed while a user is showering. A user rubs their feet on the sandy surface without bending or use of the hands. This causes the dead skin to be removed from a person's feet.

The mat includes an adhesive or holding part for holding the device to the shower or bathtub floor. In a preferred embodiment, the mat includes suction cups or a suction channel on the bottom of the mat which holds the mat in place. In a preferred embodiment, the mat has antibacterial and mildew resistant properties.

In an embodiment, the mat is rolled up after use. In an embodiment the mat is hang dried. In a preferred embodiment, the mat is big enough so that a person can stand on the mat with both feet.

In an embodiment, the mat has a piece cut out of it to fit over a drain or the mat has perforations so as to allow water, dead skin or hair to exit the mat and filter through the drain.

In an embodiment, the mat to has a material sprayed onto it which allows the mat to become sandy and abrasive to allow a user to scrape dead skin off of their feet.

In an embodiment, the mat is made of two pieces. One bottom part of the mat is made of a light weight foam material with an adhesive device so that it stays in the bath or shower. A top layer is added to the bottom layer. The top layer consists of a sandy or abrasive material. An adhesive material is placed between the two layers so that they stay together. In this manner when the abrasive layer is no longer abrasive, it can be replaced with a new layer.

In an embodiment, the mat has a beveled edge.

In an embodiment, the mat has a back portion with a ridge. The ridge provides an area for a user to massage their feet by moving their feet in a back and forth manner over the ridge. In a preferred embodiment, the back portion of the mat is made of a rougher grade than the forward portion as to provide a surface for massaging the feet. The front portion has no ridges and is made of a smooth material.

The present invention further comprises a mesh bag. In an embodiment, the bag is made of nylon. In an embodiment, the bag has antibacterial and mildew resistant properties. In an embodiment, the mat is rolled up and placed in the bag and drip dried after use.

In an embodiment, the mat is in the shape of an oval. In an embodiment, the mat is approximately 12" to 16" in size.

Figure 1:
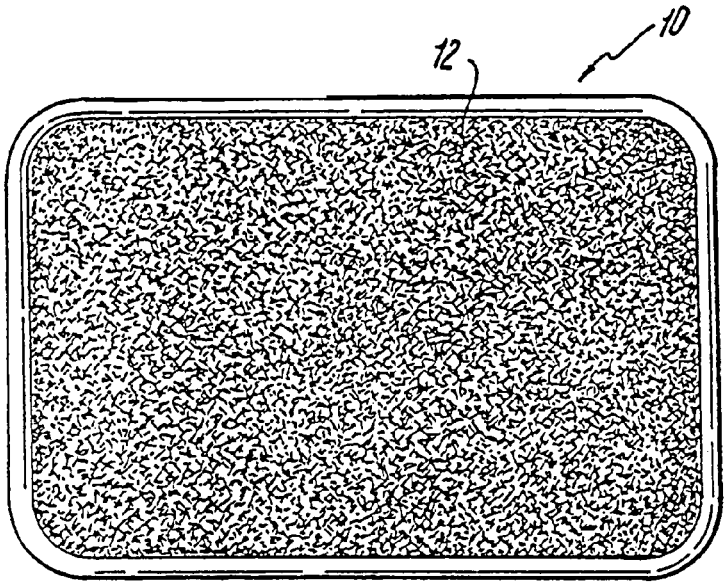
FIG. 1 is a top view of the device of the present invention.
Figure 2:
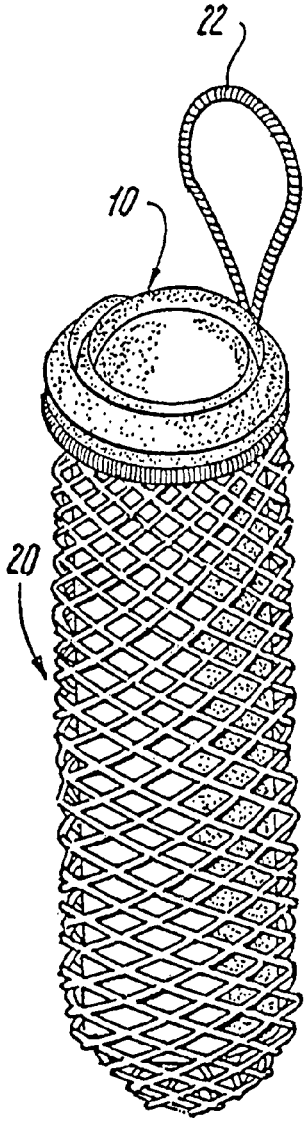
FIG. 2 is a side view of a bag for holding the device of the present invention.

FIG. 1 shows the mat 10 from a top view. The mat 10 has a rough or sandy surface 12. FIG. 2 shows the device 10 rolled up and placed in a mesh bag 20. The mat 10 is then drip dried in the bag. The bag 20 has a loop string 22 that is pulled closed and then can be hung on a hook or any door handle.

Figure 3:
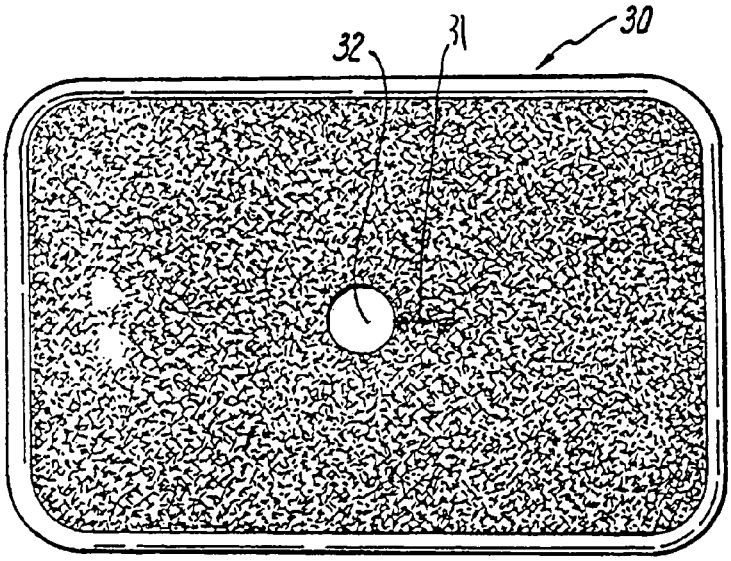
FIG. 3 is a top view of the device of the present invention.

FIG. 3 shows the mat 30 from a top view. The mat 30 has a rough or sandy surface. The mat 30 has a hole 32 which is placed over a drain within a bath or shower and/or has perforations 31.

Figure 4:
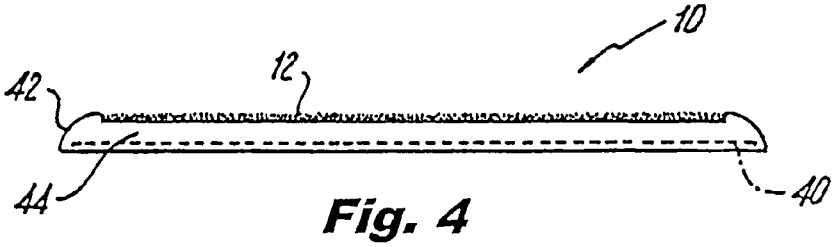
FIG. 4 is a side view of the device of the present invention.

FIG. 4 is a side view of the mat 10. Mat 10 has a sandy or rough surface 12. The mat 10 has suction cups or a suction channel 40. The mat 10 is made of a foamy or cushion like material 44. The mat 10 has a bull nose edging 42 on one or both ends of the mat 10.

Figure 5:
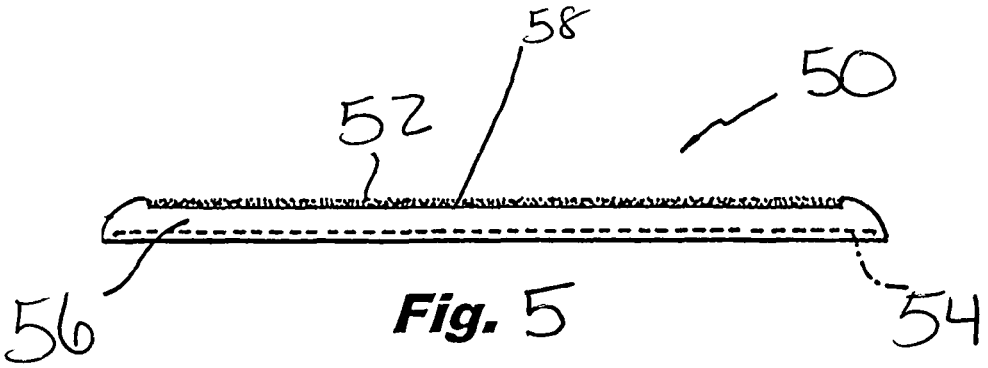
FIG. 5 is a side view of the device of the present invention.

FIG. 5 is a side view of mat 50 having a top section 52 and a bottom section 56. The bottom section has an adhesive or holding part 54 for holding the mat against the floor of a bath or shower. An adhesive material 58 holds the top section 52 to the bottom section 56.

The invention claimed is:

1. A bath or shower mat for removing dead skin from a person's foot comprising:

a single layer mat comprised of a foamy, cushioned, and light weight material;

said mat comprising an upper surface and bottom surface;

said upper surface comprised completely of a rough like flat surface;

said mat comprising a bullnose edging on one or both ends of said mat;

said mat comprised of a device for holding said bottom surface against a floor;

said mat has a piece cut out of it to fit over a drain or said mat has perforations so as to allow water or hair to exit said mat and filter through said drain.

2. A method for removing dead skin from a person's foot comprising:

placing both of a person's feet on a single layer flat surface mat in a bath or shower;

rubbing a single foot at a time on said mat;

removing dead skin from said foot;

repeating said method with a second foot;

said mat comprised of a completely rough flat surface and a foamy, cushioned, and light weight material;

said mat comprised of a bullnose edging on one or both ends of said mat and said mat has a piece cut out of it to fit over a drain or said mat has perforations so as to allow water or hair to exit said mat and filter through the drain;

said method done without bending or use of a person's hands.

3. The mat of claim 1 wherein said device for holding said bottom surface against a floor comprises suction cups or a suction channel.

4. The mat of claim 1 wherein said mat comprises antibacterial and mildew resistant properties.

5. The mat of claim 1 wherein said mat is rolled up after use.

6. The mat of claim 1 wherein said mat is hang dried after use.

7. The mat of claim 1 wherein said mat is large enough so a person can stand on said mat with both feet.

8. The mat of claim 1 wherein said mat comprises PVC, plastic, rubber, composite, soft-foam, silicone, or vinyl.

9. The mat of claim 5 wherein said mat is placed in a bag after it is rolled up.

10. The mat of claim 9 wherein said bag comprises a mesh bag.

11. The mat of claim 9 wherein said bag is comprised of nylon.

12. The mat of claim 9 wherein said bag has antibacterial and mildew resistant properties.

13. The mat of claim 9 wherein said bag is approximately 12" to 16" in size.

14. The mat of claim 9 wherein said bag is pulled closed and then can be hung on a hook or any door handle.

15. The mat of claim 1 wherein said mat comprises a bull nose edging at both ends of said mat.

* * * * *